US010113303B2

(12) United States Patent
Mardian et al.

(10) Patent No.: US 10,113,303 B2
(45) Date of Patent: Oct. 30, 2018

(54) COVER ASSEMBLY FOR A FLOOR DRAIN

(71) Applicant: Drain Dome LLC, Roanoke, VA (US)

(72) Inventors: Karl Anthony Mardian, Roanoke, VA (US); Colin David Campbell, Daleville, VA (US)

(73) Assignee: Drain Dome LLC, Roanoke, VA (US)

( * ) Notice: Subject to any disclaimer, the term of this patent is extended or adjusted under 35 U.S.C. 154(b) by 0 days.

(21) Appl. No.: 15/922,083

(22) Filed: Mar. 15, 2018

(65) Prior Publication Data

US 2018/0266096 A1 Sep. 20, 2018

Related U.S. Application Data

(60) Provisional application No. 62/471,997, filed on Mar. 16, 2017.

(51) Int. Cl.
*E03F 5/06* (2006.01)

(52) U.S. Cl.
CPC ..... *E03F 5/06* (2013.01)

(58) Field of Classification Search
None
See application file for complete search history.

(56) References Cited

U.S. PATENT DOCUMENTS 854,986 A * 5/1907 De Weese ..... F24B 1/191 126/319
864,884 A * 9/1907 Capaldi ..... 210/463
926,704 A * 6/1909 Levy ..... 210/463
929,727 A * 8/1909 Sullivan ..... E03C 1/264 285/191
931,019 A * 8/1909 Dawes et al. ..... E03C 1/22 210/163
1,195,827 A * 8/1916 Lucke ..... E03C 1/22 210/163
1,487,161 A * 3/1924 Holt ..... E04D 13/0409 210/166

(Continued)

FOREIGN PATENT DOCUMENTS

JP H0665961 A 3/1994
JP 2000-352157 A 12/2000

OTHER PUBLICATIONS

International Search Report and Written Opinion dated Aug. 23, 2018 in corresponding international application No. PCT/US2018/022832.

(Continued)

*Primary Examiner* — Robert J Popovics
(74) *Attorney, Agent, or Firm* — Nelson Mullins Riley & Scarborough, LLP

(57) ABSTRACT

A cover assembly for a drain comprises a saucer-shaped cover body having a first side configured to face toward a drain opening in a surface and a second side configured to face away from the drain opening. The cover body defines a plurality of flow passages extending between the first side and the second side so as to allow a liquid to pass through the cover body to the drain opening. At least a portion of the second side of the cover body may have a corrugated configuration formed by adjacent grooves and ridges, the grooves and ridges cooperating to facilitate reduction in blockage of the flow passages by debris on the second side of the cover body.

19 Claims, 8 Drawing Sheets

(56) References Cited

U.S. PATENT DOCUMENTS 1,494,882 A * 5/1924 Barger ..... E03C 1/264 4/292
1,618,679 A * 2/1927 Schifter ..... E03C 1/26 4/292
1,653,403 A * 12/1927 McCue ..... F16L 55/136 138/96 R
1,721,472 A * 7/1929 Rose ..... E04D 13/0409 210/166
1,746,683 A * 2/1930 Schifter ..... E03C 1/262 4/287
1,773,640 A * 8/1930 Prasivka ..... E03F 5/042 210/164
1,999,277 A * 4/1935 Boosey ..... E04D 13/0409 210/163
2,311,654 A * 2/1943 Filkins ..... E04D 13/0409 210/166
2,773,554 A * 12/1956 Lindorf ..... E03F 5/042 138/90
2,783,852 A * 3/1957 Sisk ..... E03F 5/0408 210/165
2,800,231 A * 7/1957 Hicks ..... E03C 1/264 210/163
2,896,223 A * 7/1959 Treslo ..... A47K 1/14 138/89
3,078,487 A * 2/1963 Hicks, Jr. ..... E03F 9/00 15/104.19
3,212,416 A * 10/1965 Boersma ..... E03F 5/06 210/163
3,245,540 A * 4/1966 Johnson ..... B01D 24/12 210/291
3,265,030 A * 8/1966 Stevens ..... B63B 13/00 114/182
3,287,742 A * 11/1966 Gaddis ..... E03C 1/26 285/191
3,377,634 A * 4/1968 Patterson ..... A47L 19/04 4/290
3,378,858 A * 4/1968 Jacuzzi ..... E04H 4/1236 210/163
3,392,844 A * 7/1968 Decarie ..... E04D 13/0409 210/463
3,525,105 A * 8/1970 Richards ..... E03C 1/262 4/287
3,598,132 A * 8/1971 Miller ..... E04H 4/1681 134/107
3,674,149 A * 7/1972 Donalson ..... E03F 5/0407 210/163
4,035,297 A * 7/1977 Aldridge ..... E04D 13/0409 137/362
4,107,929 A * 8/1978 Ebeling ..... E04D 13/0409 210/163
4,112,691 A * 9/1978 Ebeling ..... E04D 13/0409 210/163
4,134,162 A * 1/1979 Sharland ..... E03C 1/264 4/292
4,170,047 A * 10/1979 Corsette ..... E04H 4/1236 4/286
4,206,692 A * 6/1980 Johnston ..... F23J 13/08 126/318
4,216,790 A * 8/1980 Stoltz ..... E03F 1/00 137/357
D256,948 S * 9/1980 Boersma ..... D23/261
4,257,892 A * 3/1981 Boersma ..... E03F 5/0407 210/163
4,505,499 A * 3/1985 Uglow ..... E04D 13/0409 285/338
4,505,814 A * 3/1985 Marshall ..... E04D 13/0409 210/166
4,523,613 A 6/1985 Fouss et al.
4,655,913 A * 4/1987 Boersma ..... E03C 1/264 210/163
4,658,449 A * 4/1987 Martin ..... E04H 4/1236 210/162
4,799,713 A * 1/1989 Uglow ..... E04D 13/0409 210/163
4,850,617 A * 7/1989 Moberly ..... E03C 1/20 285/137.11
4,871,451 A * 10/1989 Piskula ..... E03F 5/0407 210/164
5,071,177 A * 12/1991 Spiess ..... E02D 29/1427 292/214
5,141,633 A * 8/1992 Walczak ..... B01D 35/02 210/163
5,165,119 A * 11/1992 Yamato ..... E03D 9/032 4/222.1
5,234,582 A * 8/1993 Savoie ..... E04D 13/0409 210/163
D343,228 S * 1/1994 Colin ..... D23/261
D348,924 S * 7/1994 Merrett ..... D23/261
5,437,516 A * 8/1995 Sauerwein ..... E02D 29/1427 404/2
5,469,670 A * 11/1995 Thaler ..... E04D 13/0409 210/163
5,526,613 A * 6/1996 Simeone, Jr. ..... E04D 13/0409 210/163
5,564,860 A * 10/1996 Amann ..... E02D 29/1427 404/2
5,650,065 A * 7/1997 Sewell ..... E02D 29/12 210/163
5,843,306 A * 12/1998 Singleton ..... B01D 29/15 210/163
5,966,884 A * 10/1999 Uglow ..... E04D 13/0409 285/42
6,092,244 A * 7/2000 Rizzardi ..... E03F 5/06 138/89
6,163,896 A 12/2000 Lee
6,165,357 A * 12/2000 Cormier ..... E04D 13/0409 210/163
6,330,724 B1 * 12/2001 Belle ..... E03C 1/22 4/286
6,360,379 B1 * 3/2002 Lane ..... E04H 4/1236 210/163
6,360,779 B1 * 3/2002 Wagner ..... F16L 55/105 138/89
6,393,631 B2 * 5/2002 Schroader ..... E04H 4/1236 4/292
6,397,408 B1 * 6/2002 Veloskey ..... E04H 4/1236 4/292
D460,810 S * 7/2002 Sommerhein ..... D23/261
6,416,674 B1 * 7/2002 Singleton ..... E03F 5/105 210/163
D466,198 S * 11/2002 Mullings ..... D23/261
6,588,029 B2 * 7/2003 Mullings ..... E04H 4/1236 4/286
6,631,588 B1 * 10/2003 Distler ..... E04D 13/0409 210/163
6,817,043 B2 * 11/2004 Zars ..... E04H 4/1236 4/292
6,945,733 B2 * 9/2005 Rathmann ..... E03F 5/06 210/163
7,178,179 B2 * 2/2007 Barnes ..... A61H 33/6073 4/292
D550,819 S * 9/2007 Seehoff ..... D23/261
7,300,573 B1 * 11/2007 Trangsrud ..... E03F 1/00 210/163
D563,529 S * 3/2008 Labonte ..... D23/261
7,618,532 B2 * 11/2009 Worth ..... E03C 1/126 210/164
D606,174 S * 12/2009 Martin ..... D23/261
D613,829 S * 4/2010 Griffin ..... D23/260
D621,009 S * 8/2010 Mjelde ..... D23/261
7,854,852 B1 * 12/2010 Reavis ..... B01D 29/01 210/767
8,043,497 B2 * 10/2011 Silverstein ..... E03F 5/0407 210/164
8,496,811 B2 * 7/2013 Cohen ..... E03F 5/041 210/163
8,496,822 B2 * 7/2013 Schoell ..... E04D 13/0409 210/163

(56) References Cited

U.S. PATENT DOCUMENTS 8,557,108 B2 * 10/2013 Rennels ..... E03C 1/264 210/163
8,557,109 B1 * 10/2013 Sutherland ..... E03F 5/0409 210/163
8,578,523 B2 * 11/2013 Eichler ..... E03C 1/264 4/286
8,628,657 B1 * 1/2014 Robillard ..... E03F 5/0407 210/163
8,679,328 B2 * 3/2014 Hebert ..... E03F 5/0404 210/163
8,834,714 B2 * 9/2014 Chien ..... E03F 1/00 210/163
8,869,319 B2 * 10/2014 Griffin ..... E04H 4/14 4/507
8,894,850 B2 * 11/2014 Coscarella ..... E03F 5/06 210/163
D726,886 S * 4/2015 Sutherland ..... D23/261
9,175,797 B1 * 11/2015 Behoteguy ..... F16L 55/115
9,340,988 B2 * 5/2016 Lyristakis ..... E04H 4/1236
9,422,708 B2 * 8/2016 Hull ..... E03F 5/0407
9,637,928 B2 * 5/2017 Liptak ..... E04D 13/0409
9,994,465 B2 * 6/2018 Epstein ..... C02F 1/68
2010/0269913 A1 * 10/2010 Hollinger ..... E03C 1/298 137/215
2011/0120924 A1 * 5/2011 Coscarella ..... E03F 5/06 210/164
2011/0240536 A1 * 10/2011 Tseng ..... E03F 5/042 210/136
2014/0158593 A1 * 6/2014 Chien ..... E03F 1/00 210/166

OTHER PUBLICATIONS

Invitation to Pay Additional Fees dated Jun. 14, 2018 in corresponding international application serial No. PCT/US2018/022832.

* cited by examiner

COVER ASSEMBLY FOR A FLOOR DRAIN

PRIORITY CLAIM

This application claims the benefit of U.S. Provisional Application No. 62/471,997 filed on Mar. 16, 2017, the entire contents of which are hereby incorporated herein by reference.

FIELD OF THE INVENTION

Example embodiments generally relate to floor drains and more particularly to a cover assembly for a floor drain.

BACKGROUND OF THE INVENTION

Some floor surfaces may be configured to drain liquid. For example, garages, basements, showers, wet rooms, or the like may be configured to drain liquid, such as water. The liquid may be applied intentionally, such as for cleaning, or may be caused by leakage, such as from plumbing, equipment, e.g., washing machines, or from the environment, such as rain runoff.

Typically, a drain opening in fluid communication with a drain pipe (e.g., a two-inch inner diameter drain pipe) is provided in the surface to convey the fluid from the surface to a sewer or other destination. The drain opening may be provided with a drain cover to prevent objects and large debris from entering the drain opening and clogging or otherwise obstructing the drain pipe.

Typical drain covers include flat discs having apertures for passage of the liquid. Another type of drain cover is raised with a high domed (e.g., frustoconical) or cylindrical configuration. Such a raised drain cover may be formed from a wire mesh or a rigid material with one or more flow holes.

SUMMARY OF THE INVENTION

Embodiments of the present provide a cover assembly for a drain (e.g., a floor drain) which has a low profile dome shape to increase the surface area for drainage without creating an obstacle for foot traffic or for swinging doors. According to one aspect of the invention, a cover assembly for a drain may comprise a saucer-shaped cover body having a first side configured to face toward a drain opening in a surface and a second side configured to face away from the drain opening. The cover body defines a plurality of flow passages extending between the first side and the second side so as to allow a liquid to pass through the cover body to the drain opening. According to this aspect, at least a portion of the second side of the cover body has a corrugated configuration formed by adjacent grooves and ridges, the grooves and ridges cooperating to facilitate reduction in blockage of the flow passages by debris that may be present on the second side of the cover body.

According to some embodiments, at least some of the flow passages may be grouped in respective first, second, and third concentric sets of flow passages. The cover body may further comprise first and second annular rings between the first and second and the second and third concentric sets of flow passages, respectively. A fourth concentric set of flow passages may also be located radially inside of the third set of concentric flow passages. The flow passages in the first, second, and third set of flow passages may be configured as radial flow slots (e.g., teardrop shaped flow slots). A plurality of support ribs may be disposed on the first side of the cover body, extending radially from an apex portion of the cover body.

Preferably, the second side of the cover body may be textured to enhance foot traction thereon. In some preferred embodiments, the cover body may have a height less than one-half of its radius and more preferably less than one-third of its radius.

Another aspect of the present invention provides a cover assembly for a drain comprising a cover body having a first side configured to face toward a drain opening in a surface and a second side configured to face away from the drain opening. The cover body defines a plurality of flow passages extending between the first side and the second side so as to allow a liquid to pass through the cover body to the drain opening. An anchor is removably attachable to the cover body so as to depend from the first side thereof, the anchor having a deformable insert structure adapted to engage an inner surface of a drain pipe.

According to some embodiments, the anchor may have a stem portion removably attachable to the cover body at a proximal end thereof, the insert structure being located at a distal end of the shaft portion. The proximal end of the stem portion may be insertable into a complementary stem receiver defined on the first side of the cover body. In some embodiments, attachment of the cover body and the anchor may be maintained at least in part by press fit. In some embodiments, the stem portion may define a blind bore in an end thereof alignable with a fastener aperture defined in the cover body such that the anchor is removably attachable to the cover body by a fastener extending through the fastener aperture into the blind bore.

Preferably, the deformable insert structure may be formed by an arm member extending around a closed loop. A portion of the arm member may be divided into substantially parallel arm segments having an open area therebetween.

A still further aspect of the present invention provides a cover assembly for a drain comprising a low profile dome-shaped cover body having a first side configured to face toward a drain opening in a surface and a second side configured to face away from the drain opening. The cover body defines a plurality of flow passages extending between the first side and the second side so as to allow a liquid to pass through the cover body to the drain opening. The cover body further defines a plurality of notches configured to enable surface flow to the drain, the notches being spaced apart around a periphery of the cover body.

Further aspects of a cover assembly of the present invention, and methods for using same, will be apparent to those skilled in the art upon reading the following detailed description in conjunction with review of the drawings.

BRIEF DESCRIPTION OF THE DRAWINGS

Reference will now be made to the accompanying drawings, which are drawn to facilitate understanding certain aspects of the present invention and are therefore not necessarily drawn to scale, and wherein.

Figure 1:
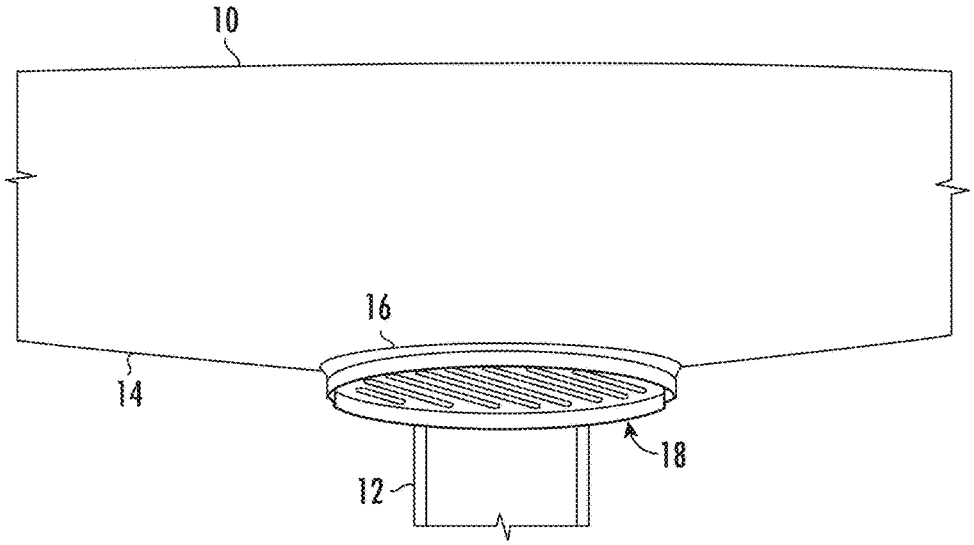
FIG. 1 PRIOR ART
FIG. 1 illustrates an example flat drain cover of the prior art.

Repeat use of reference characters in the present specification and drawings is intended to represent same or analogous features or elements of the invention according to the present disclosure.

DESCRIPTION OF PREFERRED EMBODIMENTS

Some example embodiments now will be described more fully hereinafter with reference to the accompanying drawings, in which some, but not all, example embodiments are shown. Indeed, the examples described and pictured herein should not be construed as being limiting as to the scope, applicability or configuration of the present disclosure. It will be apparent to those skilled in the art that modifications and variations can be made in such example embodiments without departing from the scope or spirit thereof. For instance, features illustrated or described in one embodiment may be used on another embodiment to yield a still further embodiment. Thus, it is intended that the present invention covers such modifications and variations as come within the scope of the appended claims, their equivalents, and the present disclosure. Like reference numerals refer to like elements throughout.

As used herein, terms referring to a direction or a position relative to the orientation of the cover assembly and adjacent structure, such as but not limited to "vertical," "horizontal," "upper," "lower," "above," or "below," refer to directions and relative positions with respect to the orientation of the apparatus in its normal intended operation, as indicated in the FIGS. herein. Thus, for instance, the terms "vertical" and "upper" refer to the vertical direction and relative upper position in the perspectives of the FIGS. and should be understood in that context, even with respect to an apparatus that may be disposed in a different orientation.

Further, the term "or" as used in this application and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be understood to mean "one or more" unless specified otherwise or clear from the context to be directed to a singular form. Throughout the specification and claims, the following terms take at least the meanings explicitly associated therein, unless the context dictates otherwise. The meanings identified below do not necessarily limit the terms, but merely provide illustrative examples for the terms. The meaning of "a," "an," and "the" may include plural references, and the meaning of "in" may include "in" and "on," and vice versa. The phrase "in one embodiment" or other similar phrase, as used herein, does not necessarily refer to the same embodiment, although it may.

Prior Art

Referring now to FIG. 1, a surface 10 (e.g., a floor in a basement) defines a drain through which liquid (e.g., water) passes into a drain pipe 12. Surface 10 may be sloped, as shown at 14, toward a drain opening 16 coaxial with drain pipe 12. A flat drain cover 18 of the prior art is seated in drain opening 16, as shown, to be flush with or slightly below surface 10. As can be seen, flat drain cover 18 is configured as a disc defining a plurality of passages therethrough for flow of liquid into the drain. The flat drain cover 18 is configured to prevent debris and objects from entering the drain pipe 12, which may clog or otherwise obstruct flow of the fluid into the drain. It will be appreciated, however, that the flat drain cover 18 has a limited surface area for liquid flow determined by the size of the drain opening 16. Additionally, the flat drain cover 18 tends to collect debris on the exposed surface, which may thereafter limit or prevent fluid flow from the surface 10 to the drain pipe 12.

Figure 2:
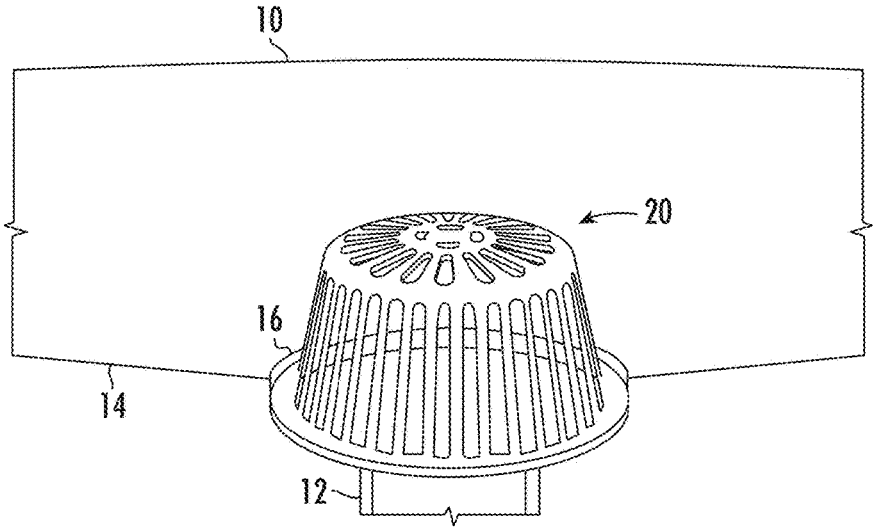
FIG. 2 PRIOR ART
FIG. 2 illustrates an example raised drain cover of the prior art.

FIG. 2 illustrates an example raised drain cover 20. The raised drain cover 20 is positioned over the drain pipe 12, similar to the flat drain cover 18 of FIG. 1. However, the raised drain cover 20 extends in the vertical direction away from the surface 10. The raised drain cover 20 may have a cylinder shape or a dome shape formed of a wire mesh, or formed of rigid plastic or metal with a plurality of flow passages. The raised drain cover 20 may create an obstacle to foot traffic, doors, or the like, which may cause a trip hazard, limit door swing, or cause the raised drain cover 20 to be damaged. The raised drain cover 20 tends to undesirably collect debris and objects around its periphery. Additionally, the raised drain cover 20 has limited flow near the surface 10, due to the orientation and placement of the flow passages.

Example Domed Drain Cover

Figure 3:
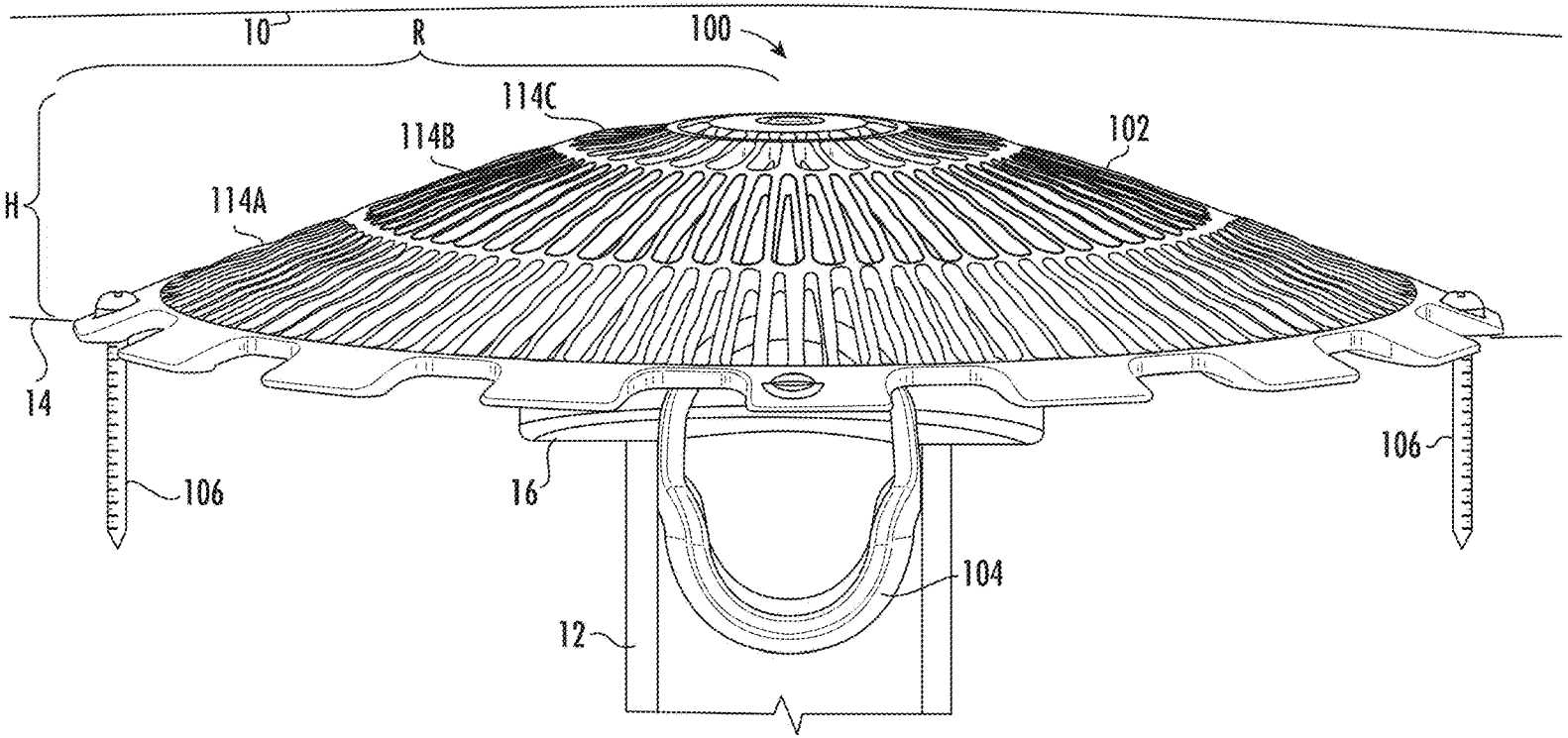
FIG. 3 illustrates a cover assembly for a floor drain in accordance with an embodiment of the present invention.
Figure 4:
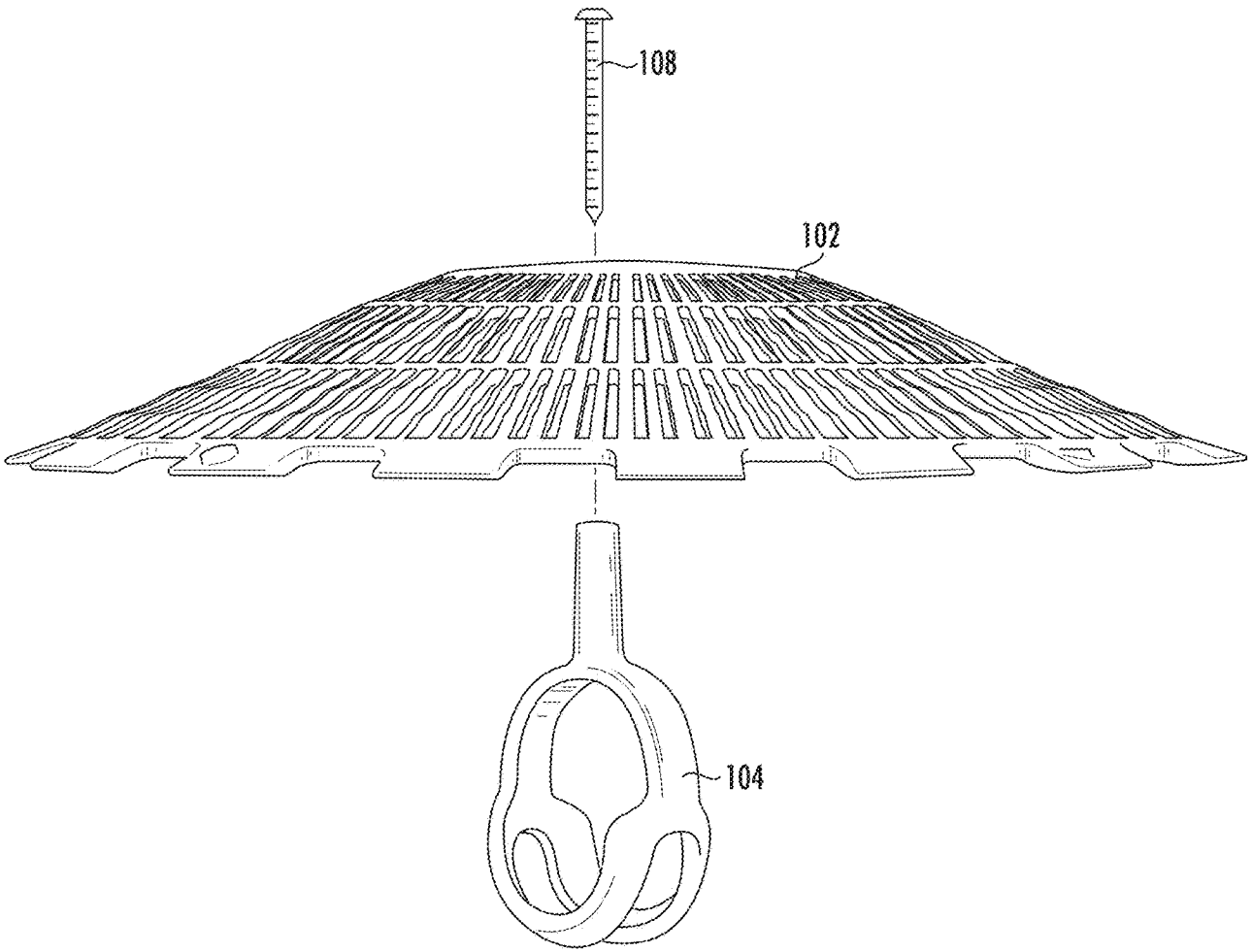
FIG. 4 illustrates an exploded view of a cover assembly for a floor drain in accordance with an embodiment of the present invention.

FIGS. 3 and 4 illustrate an example cover assembly 100 in accordance with an embodiment of the present invention. Cover assembly 100 includes a main cover body 102 to which an anchor 104 is attached. As can be seen, cover body 102 has shallow dome-shaped configuration with a first side, i.e., underside, for facing toward a drain opening 16 and a second side, i.e., exposed upper side, facing away from the drain opening 16. Cover body 102 defines a multiplicity of flow passages through which liquid flows from the second side to the first side and into the drain. The flow passages may be formed as circles, rectangles, squares, slots, or any other suitable shape as necessary or desired. In any event, however, the flow passages are sized such that larger debris which would clog drain pipe 12 will not pass through cover body 102.

In this embodiment, for example, the cover body 102 defines a plurality of concentric sets 114A, 114B, 114C of radial flow slots that extend through the cover body 102. In this example, each of the flow slots within the sets 114A, 114B, 114C may have a "teardrop" configuration that is wider at its distal end (i.e., farther from the radial center) than at its proximal end (i.e., closer to the radial center). In addition, flow slots of one set (e.g., set 114A) may be angularly offset from flow slots of the next concentric set (e.g., set 114B). This increases the likelihood that liquid flowing from a higher location on cover body 102 will encounter one or more slots as it flows.

The cover body 102 may be anchored, or secured, in place over the drain opening 16 by one or more fasteners 106, such as screws, rivets, nails, or the like. The fasteners may each pass through a respective mounting bore 112 (FIG. 5) in the cover body 102. In this case, for example, a total of four mounting bores 112 are spaced apart around the periphery of the cover body 102. Additionally or alternatively, the cover body 102 may be secured in position by an anchor 104. One end of the anchor 104 may be connected to the cover body 102, such as via a screw 108. An insertion structure 128 (FIG. 8) is located at the other end of the anchor 104 for insertion into the drain pipe 12. As will be discussed more fully below, the insertion structure 128 preferably engages the interior walls of the drain pipe 12 to retain the cover assembly 100 in position.

The underside of the cover body 102 may define a stem receiver 124 (FIG. 7) configured to receive the proximal end of the stem portion 126 (FIG. 8) of the anchor 104. In this regard, the proximal end of the stem portion 126 may preferably be complementary to the configuration of the receiver 124. For example, the stem receiver 124 may be configured as a circular recess, a square recess, a hexagonal recess, or the like depending on the shape of the proximal end of the stem portion 126. In some example embodiments, such as when stem receiver 124 and the proximal end of stem portion 126 are square or hexagonal in shape, relative rotation between the cover body 102 and the anchor 104 may be inhibited. In some embodiments, the connection between the proximal end of the anchor 104 and the stem receiver 124 may be an interference fit in lieu of or in addition to the use of a fastener such as screw 108.

As noted above, the cover body 102 preferably has a shallow (i.e., low profile) domed configuration so that it does not significantly protrude above the surface of the floor. In this case, for example, the cover body 102 may be substantially "saucer-shaped." Cover assembly 100 thus presents less of an obstruction to foot traffic and will generally remain below any swinging doors. The low profile may be characterized by a height (H) that is significantly smaller than the radius (R) of the cover body 102. For example, the height (H) may less than one-half (½), and will preferably be less than one-third (⅓), of the radius (R) of the cover body 102. In one embodiment, for example, the height (H) of the cover body 102 may be less than two inches (e.g., 1.74 inches) with a radius (R) of 5.5-6 inches (e.g., 5.87 inches). One skilled in the art will appreciate that slope 14 of the floor will further reduce any tendency of cover assembly 100 to create an obstruction.

Figure 5:
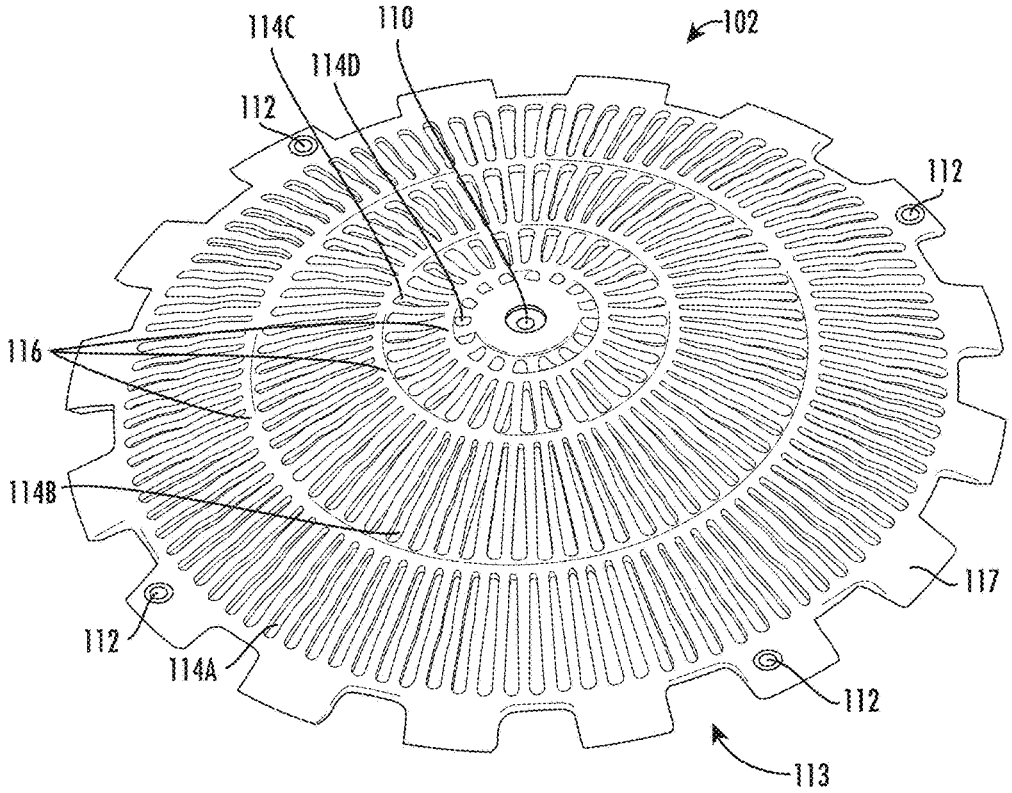
FIG. 5 illustrates a perspective view of an upper side of a cover body according to an example embodiment.

FIG. 5 illustrates a perspective view of the exposed side of cover body 102 according to an example embodiment. As shown, cover body 102 may include a fastener aperture 110 at its radial center configured to receive the screw 108. The screw 108 may pass into a blind bore 127 (FIG. 8) defined in the stem portion 126 of the anchor 104. Cover body 102 and anchor 104 are thus removably interconnected to each other in this embodiment. As discussed above, cover body 102 may, additionally or alternatively, include one or more mounting bores 112 spaced apart about its periphery. In this case, a respective fastener 106 may extend through the mounting bores 112 to secure cover body 102 to the surface 10.

As noted above, concentric sets 114A, 114B, 114C of radial flow slots may be defined in cover body 102 for passage of liquid to the drain. A further set 114D of flow passages may be located concentrically inside of set 114C. The wide low profile of the cover body 102 and the flow passages of sets 114A, 114B, 114C, 114D advantageously provide a large surface area for conveying liquid from the surface 10 into the drain. As a result, relatively quick drainage may be achieved in comparison with conventional flat drain covers 18 or raised drain covers 20.

The cover body 102 may also preferably define a plurality of surface level flow passages, here in the form of notches 113, disposed in spaced apart relation about its periphery. Specifically, the notches 113 are configured to enable surface level drainage directly to the drain. The notches 113 may be any suitable shape, e.g., semi-circular, triangular, rounded squares or rectangles, or other suitable shapes. The notches 113 preferably allow a high fluid flow rate near the surface 10. Due to the configuration of the cover body 102, flowing water may desirably cause debris (e.g., leaves) to be pushed over the notches 113 and onto the exposed surface of cover body 102. As a result, the restriction to surface level flow that might otherwise occur may be at least substantially reduced. This may be particularly beneficial where debris floats on the fluid above the level of the notches although upward movement of the debris is also facilitated by the ramp-like structures 117 between notches 113.

The cover body 102 may also include one or more annular support rings 116 between the sets 114A, 114B, 114C, 114D of flow passages. The annular support rings 116 add structural rigidity to the cover body 102 and otherwise serve as a portion of a structural frame (discussed below in regard to FIG. 7).

Figure 6:
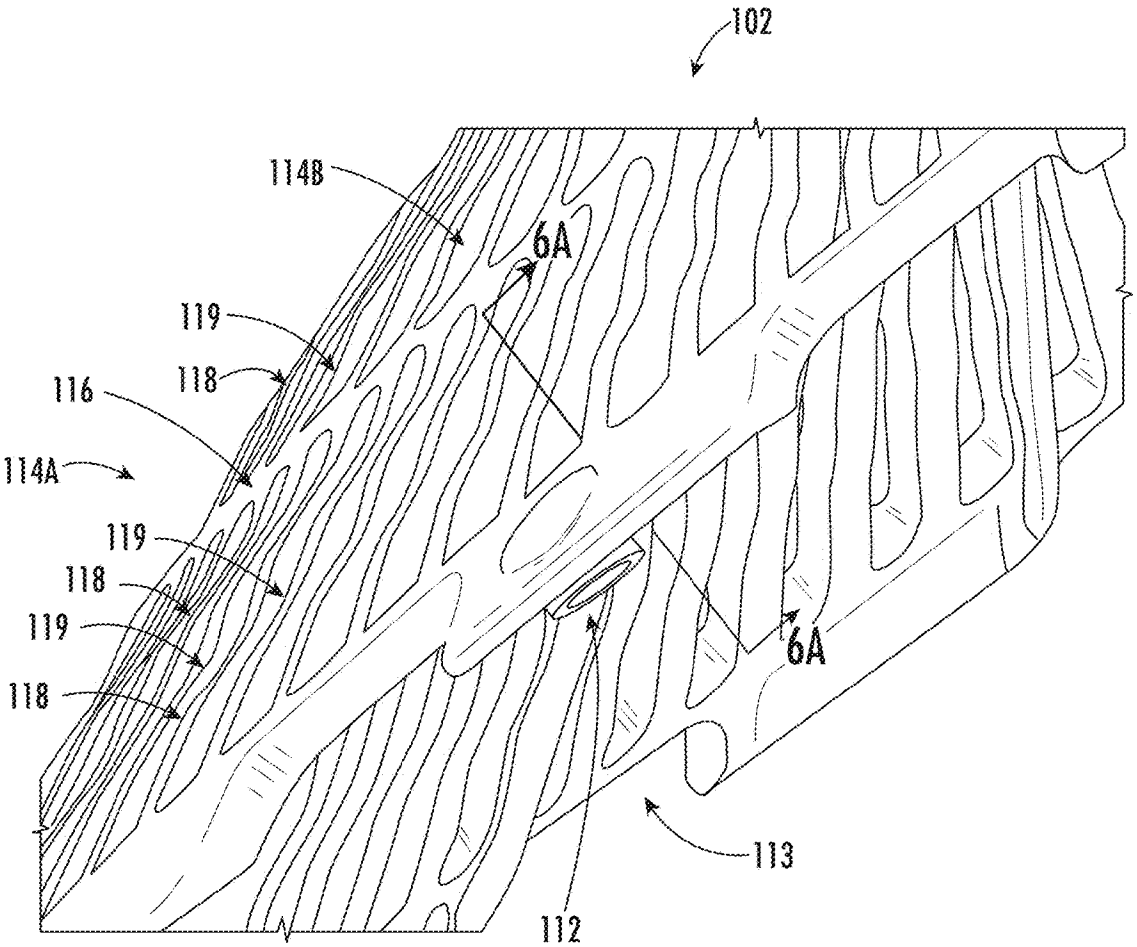
FIG. 6 illustrates an enlarged fragmentary view of a portion of a cover body according to an example embodiment.
Figure 6A:
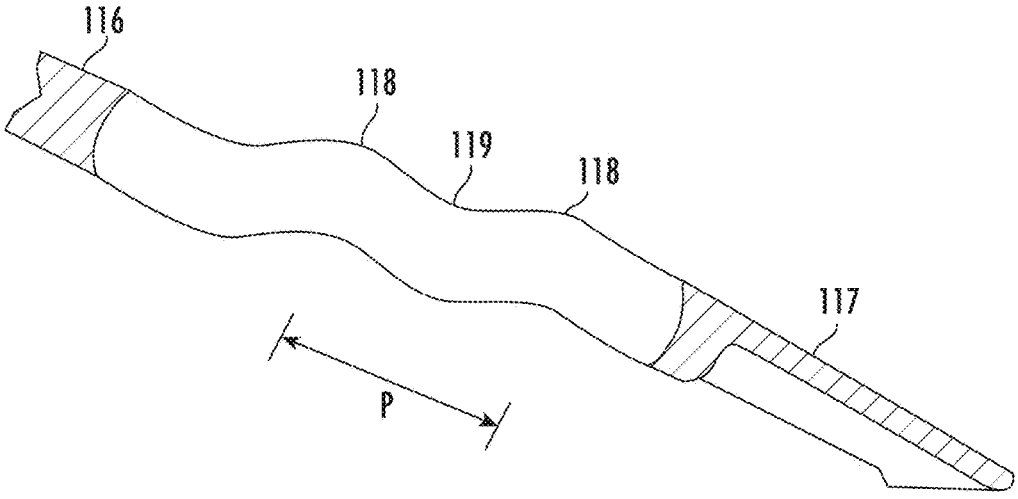
FIG. 6A is an enlarged cross-sectional view of a portion of the cover body of FIG. 6 taken along line 6A-6A.

Additional detail regarding the cover body 102 may be explained with reference to FIG. 6. As shown, the upper exposed side of cover body 102 may be corrugated including a plurality of ridges 118 and corresponding grooves 119 between each of the rings 116. Referring now also to FIG. 6A, the corrugation is configured (e.g., the ridges 118 and grooves 119 are sized and spaced) to allow some liquid flow under objects (such as leaves) located on the exposed side of main body 102. For example, in a preferred embodiment, the pitch P (i.e., the distance from one ridge to the next) may be in the range of 0.25 inches to 1 inches (e.g., 0.63 inches). The debris will be supported on the cover body 102 by the ridges 118. Liquid, on the other hand, passes into the grooves 119, through the flow passages, and to the drain. The corrugation thus allows cover body 102 to be significantly less susceptible to blockage compared to conventional flat drain covers 18 or raised drain covers 20.

In addition to corrugation, the exposed surface of cover body 102 may be textured so as to enhance foot traction if cover body 102 is stepped on by a person. The texturing may be any suitable texturing for reduction of slippage, such as bumps, grooves, crisscrossed ridges, or other suitable texturing.

Figure 7:
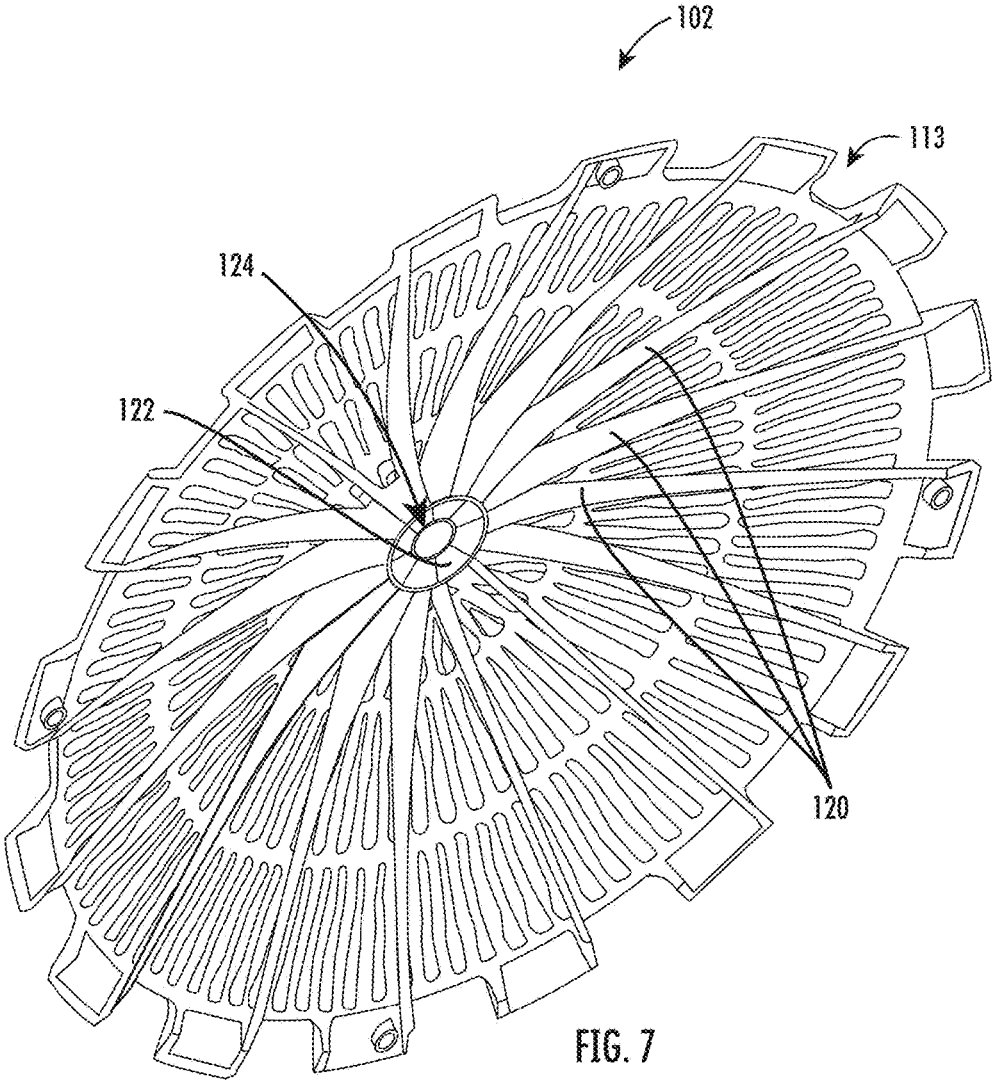
FIG. 7 illustrates a perspective view of an underside of a cover body according to an example embodiment.

FIG. 7 illustrates a perspective view of the underside of the cover body 102. As can be seen, cover body 102 may include a plurality of support ribs 120. The support ribs 120 in this embodiment are disposed on the underside of the main body 102 and extend radially from an apex portion of the cover body 102. In this embodiment, each support rib 120 extending in one radial direction is aligned with another support rib 120 extending in the opposite radial direction. The support ribs act in a manner substantially similar to an arch, in that point pressure is dispersed along the arch when applied.

The support ribs 120 and the annular support rings 116 are preferably interconnected, or formed together, as a "ribbed dome" support structure. In addition, the cover body 102 may also include a support projection 122 concentric with stem receiver 124. The support ribs 120 may be connected to, and extend radially from, the support projection 122 such that the support projection has characteristics similar to a key stone of an arch. The ribbed dome support structure may add significant strength to the cover body 102 enabling it to withstand normal foot traffic, impact due to dropped items, or the like. The cover body 102, may for example withstand downward pressure in excess of 300 lbs.

In some example embodiments, the stem receiver 124 may be disposed on, or formed as a portion of, the support projection 122. In an example embodiment, the support projection 122 may have a substantially cylindrical shape and the stem receiver 124 comprises a concentrically aligned recess within the cylindrical projection 122.

Figure 8:
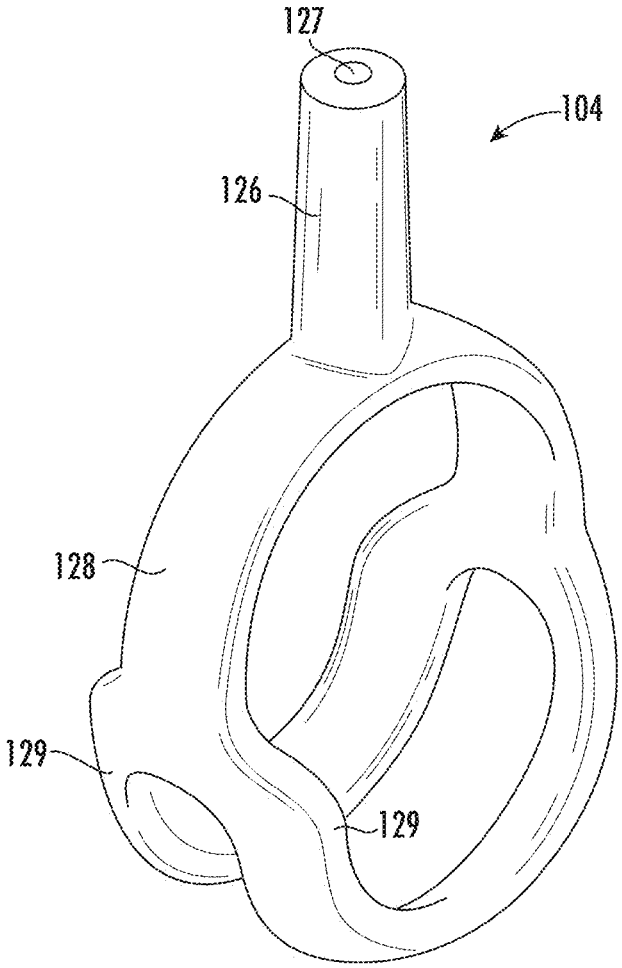
FIG. 8 illustrates an example anchor that may be used with a cover body according to an example embodiment.

FIG. 8 illustrates anchor 104 according to an example embodiment. In this embodiment, the anchor 104 may comprise a stem portion 126 (i.e., a shaft) to which an insert structure 128 is attached. As noted above, the stem portion 126 may be received by the stem receiver 124 (FIG. 6) and connected thereto by an interference fit and/or a fastener (e.g., screw 108, FIG. 4). The stem portion 126 may define a blind bore 127 to receive the fastener.

In this case, insert structure 128 has the form of a closed loop (e.g., a generally circular or oval shape). The sides of the insert structure 128 may deform inward when inserted into the drain pipe 12, which, in turn, causes the insert structure 128 to exert pressure on the internal wall of the drain pipe 12. In an example embodiment, the distal end of insert structure 128 splits into a fork shape as shown. This may increase the bias toward the at rest position causing a greater force to be applied to the interior walls of the drain pipe 12. This fork shape also provides an opening in insert structure 128 for passage of liquid through anchor 104. One skilled in the art will appreciate, however, that various insert structure configurations may be provided that are not formed as a closed loop. For example, various discrete arms may flexibly engage the inner surface of drain pipe 12. Embodiments are also contemplated in which anchor 104 serves only to center cover body 102 (rather than resisting its removal) with respect to the drain.

Cover body 102 and/or the anchor 104 may be formed of a relatively rigid plastic material, such as injection molded nylon, a metal, such as cast or machined aluminum, steel, stainless steel, or the like, or other suitable material. When formed from rigid plastic, the material may provide sufficient support to the structure of the cover body 102 and/or anchor 104 and allow for some flexion in the structure. This flexion may enable the cover body 102 and/or the anchor 104 to withstand higher pressure applications, such as tire traffic from warehouse vehicles, trucks, or the like, without suffering breakage or permanent deformation.

CONCLUSION

It can thus be seen that the present invention provides a novel cover assembly for a drain. Many modifications and other embodiments of the invention set forth herein will come to mind to one skilled in the art to which this invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Moreover, although the foregoing description and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. A cover assembly for a drain comprising:

a saucer-shaped cover body having a first side for facing toward a drain opening in a surface having a drain pipe and a second side for facing away from the drain opening, the saucer-shaped cover body defining a plurality of flow passages extending between said first side and said second side so as to allow a liquid to pass through the cover body to the drain opening, at least a portion of the second side of the saucer-shaped cover body having a corrugated configuration formed by adjacent grooves and ridges, said grooves and ridges cooperating to facilitate reduction in blockage of said flow passages by debris on said second side of said saucer-shaped cover body; and an anchor having a stem and deformable insert structure having a width diameter greater than the internal diameter of said drain pipe, said stem being removably attachable to said saucer-shaped cover body so as to depend from said first side thereof, and said insert structure including a pair of split fork loops at a distal end thereof sized to deform inwardly when inserted into the drain pipe and cause the insert structure to exert pressure on and frictionally engage the internal wall of the drain pipe.

2. The cover assembly of claim 1, wherein at least some of said flow passages are grouped in respective first, second, and third concentric sets of said flow passages.

3. The cover assembly of claim 1, wherein said saucer-shaped cover body comprises first and second annular rings between said first and second and said second and third concentric sets of said flow passages, respectively.

4. The cover assembly of claim 2, further comprising a fourth concentric set of flow passages located radially inside of said third set of concentric flow passages.

5. The cover assembly of claim 2, wherein respective of said flow passages in said first, second, and third set of flow passages are flow slots.

6. The cover assembly of claim 5, wherein each of said flow slots has a generally teardrop configuration which is narrower at a proximal end and wider at a distal end.

7. The cover assembly of claim 1, wherein at least some of said flow passages are formed as radial flow slots.

8. The cover assembly of claim 1, wherein said saucer-shaped cover body further comprises a plurality of support ribs disposed on the first side and extending radially from an apex portion of the cover body.

9. The cover assembly of claim 1, wherein said saucer-shaped cover body defines at least one mounting bore therethrough, said mounting bore receiving a fastener for securing said saucer-shaped cover body to said surface.

10. The cover assembly of claim 1, wherein said saucer-shaped cover body defines a plurality of surface level flow paths to enable surface flow to the drain, said surface level flow paths being spaced apart around a periphery of said cover body.

11. The cover assembly of claim 1, wherein the second side of said saucer-shaped cover body is textured to enhance foot traction thereon.

12. The cover assembly of claim 1, wherein the saucer-shaped cover body has a height less than one-half of its radius.

13. The cover assembly of claim 1, wherein the height of the saucer-shaped cover body is less than one-third the radius of the saucer-shaped cover body.

14. The cover assembly of claim 1, wherein said anchor has a stem portion removably attachable to said saucer-shaped cover body at a proximal end thereof, said insert structure being located at a distal end of said stem portion.

15. The cover assembly of claim 1, wherein said proximal end of said stem portion is insertable into a complementary stem receiver defined on said first side of said saucer-shaped cover body.

16. The cover assembly of claim 15, wherein attachment of said cover body and said anchor is maintained at least in part by press fit.

17. The cover assembly of claim 15, wherein said stem portion of said anchor defines a blind bore in an end thereof alignable with a fastener aperture defined in said saucer-shaped cover body, said anchor being removably attachable to said saucer-shaped cover body by a fastener extending through said fastener aperture into said blind bore.

18. The cover assembly of claim 1, wherein said cover body defines a plurality of spaced apart mounting bores therethrough, said mounting bores receiving a respective fastener for securing said saucer-shaped cover body to said surface.

19. The cover assembly of claim 1, wherein said saucer-shaped cover body defines a plurality of notches to enable surface flow to the drain, said notches being spaced apart around a periphery of said saucer-shaped cover body.

* * * * *